US006729158B2

(12) United States Patent
Sakai et al.

(10) Patent No.: US 6,729,158 B2
(45) Date of Patent: May 4, 2004

(54) EJECTOR DECOMPRESSION DEVICE WITH THROTTLE CONTROLLABLE NOZZLE

(75) Inventors: Takeshi Sakai, Chiryu (JP); Satoshi Nomura, Kariya (JP); Hirotsugu Takeuchi, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/360,504

(22) Filed: Feb. 6, 2003

(65) Prior Publication Data

US 2003/0145613 A1 Aug. 7, 2003

(30) Foreign Application Priority Data

Feb. 7, 2002 (JP) ..... 2002-030924
Jun. 24, 2002 (JP) ..... 2002-182872

(51) Int. Cl.[7] ..... F25B 1/06
(52) U.S. Cl. ..... 62/500; 62/191
(58) Field of Search ..... 62/191, 116, 500, 62/527, 512

(56) References Cited

U.S. PATENT DOCUMENTS

| | | | | |
|---|---|---|---|---|
| 3,496,735 | A | | 2/1970 | Haisma |
| 3,701,264 | A | * | 10/1972 | Newton |
| 3,782,131 | A | | 1/1974 | Merryfull |
| 4,129,012 | A | | 12/1978 | Mairs |
| 4,707,278 | A | | 11/1987 | Breyer |
| 5,343,711 | A | * | 9/1994 | Kornhauser et al. |
| 6,138,456 | A | * | 10/2000 | Garris |
| 6,438,993 | B2 | * | 8/2002 | Takeuchi et al. |
| 6,477,857 | B2 | * | 11/2002 | Takeuchi et al. |
| 6,584,794 | B2 | * | 7/2003 | Takeuchi et al. |

FOREIGN PATENT DOCUMENTS

| | | | |
|---|---|---|---|
| EP | 0 020 146 | | 12/1980 |
| EP | 0 487 002 | | 5/1992 |
| EP | 1 134 517 | A2 * | 3/2001 |
| EP | 1 134 517 | | 9/2001 |
| EP | 1 160 522 | | 12/2001 |
| JP | 62-206348 | | 9/1987 |
| JP | 6-002964 | | 1/1994 |
| JP | 11-037306 | | 2/1999 |
| JP | 2000-055211 | | 2/2000 |
| JP | 0 2001289536 | A * | 10/2001 |
| JP | 0 2002130874 | A * | 5/2002 |
| JP | 0 2002227799 | A * | 8/2002 |

OTHER PUBLICATIONS

Patent Abstracts of Japan, Publication No. 61200400 dated Apr. 9, 1986.

Patent Abstracts of Japan, Publication No. 04276200 dated Jan. 10, 1992.

Patent Abstracts of Japan, Publication No. 01196000 dated Jul. 8, 1989.

* cited by examiner

*Primary Examiner*—William E. Tapolcai
*Assistant Examiner*—Mohammad M. Ali
(74) *Attorney, Agent, or Firm*—Harness, Dickey & Pierce, PLC

(57) ABSTRACT

An ejector for a refrigerant cycle includes a nozzle having therein a refrigerant passage, and a needle valve provided in the refrigerant passage of the nozzle upstream from a throat portion of the nozzle. The needle valve is disposed in the nozzle to define therebetween a throttle portion that is positioned upstream from the throat portion. A top end portion of the needle valve and an inner wall of the nozzle are formed, so that refrigerant is decompressed to a gas-liquid two-phase state at upstream of the throat portion. Accordingly, a throttle degree of the nozzle can be variably controlled while ejector efficiency is not deteriorated.

17 Claims, 6 Drawing Sheets

EJECTOR DECOMPRESSION DEVICE WITH THROTTLE CONTROLLABLE NOZZLE

CROSS-REFERENCE TO RELATED APPLICATION

This application is related to and claims priority from Japanese Patent Applications No. 2002-30924 filed on Feb. 7, 2002 and No. 2002-182872 filed on Jun. 24, 2002, the contents of which are hereby incorporated by reference.

BACKGROUND OF THE INVENTION

1. Field of the Invention

The present invention relates to an ejector decompression device for a vapor compression refrigerant cycle. More specifically, the present invention relates to an ejector with a throttle controllable nozzle in which a throttle degree can be controlled.

2. Description of Related Art

In an ejector cycle, pressure of refrigerant to be sucked into a compressor is increased by converting expansion energy to pressure energy in a nozzle of an ejector, thereby reducing motive power consumed by the compressor. Further, refrigerant is circulated into an evaporator by using a pumping function of the ejector. However, when energy converting efficiency of the ejector, that is, ejector efficiency $\eta e$ is reduced, the pressure of refrigerant to be sucked to the compressor cannot be sufficiently increased by the ejector. In this case, the motive power consumed by the compressor cannot be satisfactorily reduced. On the other hand, a throttle degree (passage opening degree) of the nozzle of the ejector is generally fixed. Therefore, when an amount of refrigerant flowing into the nozzle changes, the ejector efficiency $\eta e$ is changed in accordance with the change of the refrigerant flowing amount. Further, according to experiments by the inventors of the present invention, if the throttle degree of the nozzle is simply changed, the ejector efficiency $\eta e$ may be greatly reduced due to a refrigerant flow loss of a control mechanism for controlling the throttle degree.

SUMMARY OF THE INVENTION

In view of the foregoing problems, it is a first object of the present invention to provide an ejector decompression device having a throttle controllable nozzle with an improved structure.

It is a second object of the present invention to variably control a throttle degree of a nozzle of the ejector decompression device without largely reducing ejector efficiency $\eta e$ of the ejector decompression device.

According to the present invention, an ejector decompression device for a refrigerant cycle includes a nozzle for decompressing and expanding refrigerant flowing from a radiator by converting pressure energy of refrigerant to speed energy of the refrigerant, a pressure-increasing portion that is disposed to increase a pressure of refrigerant by converting the speed energy of refrigerant to the pressure energy of refrigerant while mixing refrigerant injected from the nozzle and refrigerant sucked from an evaporator of the refrigerant cycle, and a needle valve disposed to be displaced in a refrigerant passage of the nozzle in an axial direction of the nozzle for adjusting an opening degree of the refrigerant passage of the nozzle. Here, the refrigerant passage is defined by an inner wall of the nozzle. Further, the nozzle includes a throat portion having a cross-sectional area that is smallest in the refrigerant passage of the nozzle, and an expansion portion in which the cross-sectional area is increased from the throat toward downstream in a refrigerant flow. In the ejector decompression device, the needle valve and the inner wall of the nozzle are provided to have predetermined shapes so that refrigerant flowing into the nozzle is decompressed to a gas-liquid two-phase state at upstream from the throat portion in the refrigerant flow. In the present invention, because refrigerant is decompressed to the gas-liquid state at upstream from the throat portion, refrigerant bubbles are generated, and a mass density of the refrigerant is reduced. Accordingly, the cross-sectional area of the refrigerant passage is relatively reduced in the nozzle. Thus, the flow amount of refrigerant can be adjusted, and the refrigerant passage can be prevented from being throttled more than a necessary degree. As a result, ejector efficiency $\eta e$ can be prevented from being largely reduced in the ejector decompression device having the nozzle where the opening degree of the refrigerant passage can be variably controlled.

Alternatively, the needle valve is disposed in the refrigerant passage of the nozzle to define a throttle portion having a cross-sectional area that is smallest in a space between the needle valve and the inner wall of the nozzle, and the throttle portion is positioned upstream from the throat portion in the refrigerant flow. Therefore, rectified refrigerant with a small disturbance can pass through the throat portion, and is sufficiently accelerated more than the sound speed while flowing through the extension portion. Because the refrigerant can be accurately sufficiently accelerated in the nozzle, the ejector efficiency can be effectively improved.

Preferably, the needle valve has a downstream portion that is tapered toward a downstream end of the needle valve so that a cross-sectional area of the downstream portion of the needle valve is reduced toward the downstream end, and the inner wall of the nozzle is formed into an approximate cone shape having at least two different taper angles, upstream from the throat portion. Further, the inner wall of the nozzle has a radial dimension that is reduced toward the throat portion. Alternatively, the inner wall of the nozzle has a radial dimension that is reduced from an upstream end of the nozzle toward the throat portion and is increased from the throat portion toward a downstream end of the nozzle.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the appended drawings.

(First Embodiment)

Figure 1:
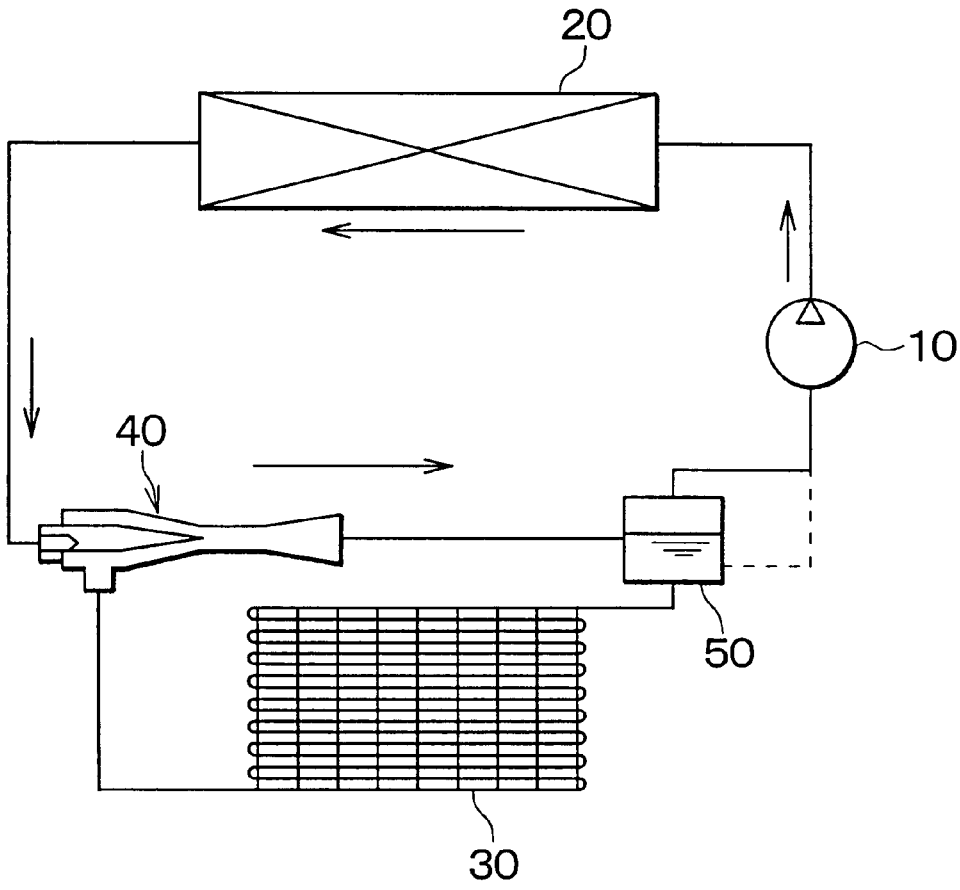
FIG. 1 is a schematic diagram showing an ejector cycle according to a first preferred embodiment of the present invention.

In the first embodiment, as shown in FIG. 1, an ejector for an ejector cycle is typically used for a heat pump cycle for a water heater. In the ejector cycle, the ejector is used as a decompression device for decompressing refrigerant. In the heat pump cycle shown in FIG. 1, a compressor 10 sucks and compresses refrigerant, and a radiator 20 cools the refrigerant discharged from the compressor 10. Specifically, the radiator 20 is a high-pressure heat exchanger that heats water for the water heater by heat-exchange between the refrigerant flowing from the compressor 10 and the water. The compressor 10 is driven by an electric motor (not shown), and a rotation speed of the compressor 10 can be controlled. A flow amount of refrigerant discharged from the compressor 10 is increased by increasing the rotational speed of the compressor 10, thereby increasing heating performance of the water in the radiator 20. On the contrary, the flow amount from the compressor 10 is reduced by reducing the rotational speed of the compressor 10, thereby reducing the heating performance of the water in the radiator 20.

In the first embodiment, since fleon is used as refrigerant, refrigerant pressure in the radiator 20 is equal to or lower than the critical pressure of the refrigerant, and the refrigerant is condensed in the radiator 20. However, the other refrigerant such as carbon dioxide may be used as the refrigerant. When carbon dioxide is used as the refrigerant, the refrigerant pressure in the radiator 20 becomes equal to or higher than the critical pressure of refrigerant, and the refrigerant is cooled without being condensed in the radiator 20. In this case, a temperature of refrigerant is reduced from an inlet of the radiator 20 toward an outlet of the radiator 20. An evaporator 30 evaporates liquid refrigerant. Specifically, the evaporator 30 is a low-pressure heat exchanger that evaporates the liquid refrigerant by absorbing heat from outside air in heat-exchange operation between the outside air and the liquid refrigerant. An ejector 40 sucks refrigerant evaporated in the evaporator 30 while decompressing and expanding refrigerant flowing from the radiator 20, and increases pressure of refrigerant to be sucked into the compressor 10 by converting expansion energy to pressure energy.

A gas-liquid separator 50 separates the refrigerant from the ejector 40 into gas refrigerant and liquid refrigerant, and stores the separated refrigerant therein. The gas-liquid separator 50 includes a gas-refrigerant outlet connected to a suction port of the compressor 10, and a liquid-refrigerant outlet connected to an inlet of the evaporator 30. Accordingly, in the ejector cycle (heat pump cycle), liquid refrigerant flows into the evaporator 30 while refrigerant from the radiator 20 is decompressed in a nozzle 41 of the ejector 40.

Figure 2:
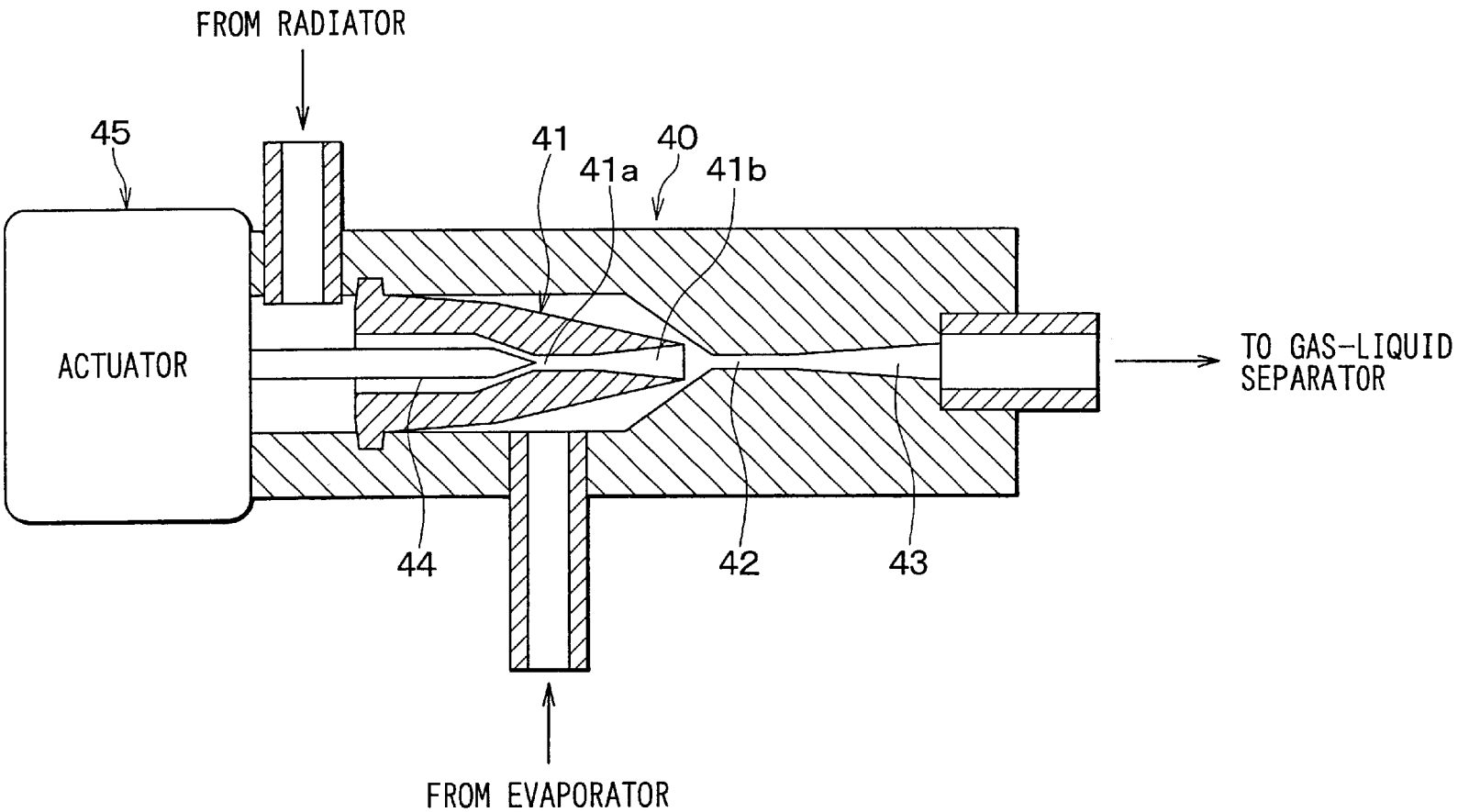
FIG. 2 is a schematic diagram showing an ejector according to the first embodiment.
Figure 3A:
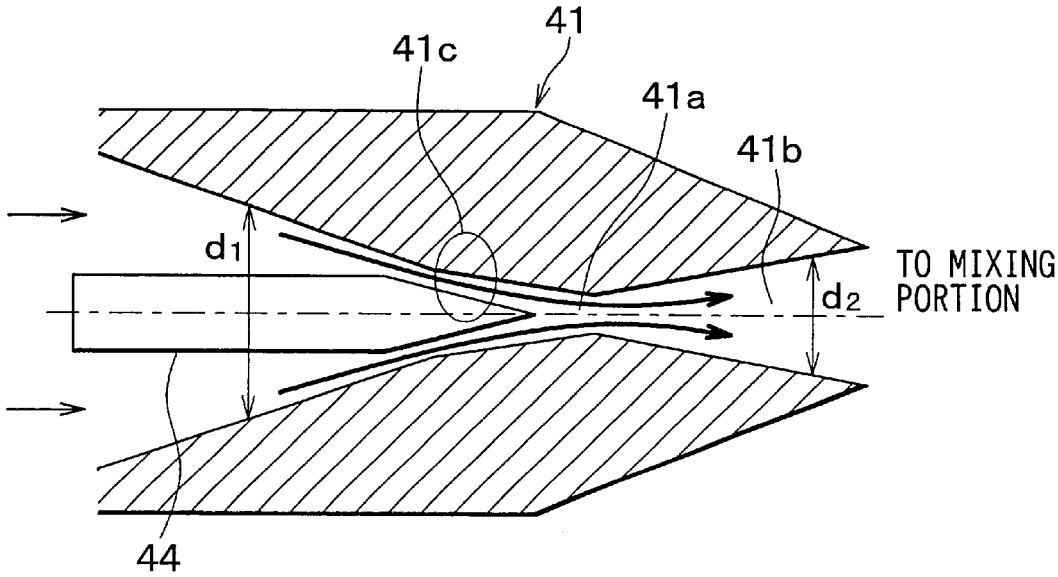
FIG. 3A is an enlarged schematic diagram showing a refrigerant flow in a nozzle of the ejector according to the first embodiment.

Next, the structure of the ejector 40 will be described in detail with reference to FIGS. 2, 3A, 3B. As shown in FIG. 2, the ejector 40 includes the nozzle 41, a mixing portion 42 and a diffuser 43. The nozzle 41 decompresses and expands high-pressure refrigerant from the radiator 20 by converting pressure energy of the high-pressure refrigerant to speed energy. Gas refrigerant from the evaporator 30 is sucked into the mixing portion 42 by a high speed stream of refrigerant injected from the nozzle 41, and the sucked gas refrigerant and the injected refrigerant are mixed in the mixing portion 42. The diffuser 43 increases refrigerant pressure by converting the speed energy of refrigerant to the pressure energy of the refrigerant while mixing the gas refrigerant sucked from the evaporator 30 and the refrigerant injected from the nozzle 41.

In the mixing portion 42, the refrigerant jetted from the nozzle 41 and the refrigerant sucked from the evaporator 30 are mixed so that the sum of their momentum of two-kind refrigerant flows is conserved. Therefore, static pressure of refrigerant is increased also in the mixing portion 42. Because a sectional area of a refrigerant passage in the diffuser 43 is gradually increased, dynamic pressure of refrigerant is converted to static pressure of refrigerant in the diffuser 43. Thus, refrigerant pressure is increased in both of the mixing portion 42 and the diffuser 43. Accordingly, in the first embodiment, the mixing portion 42 and the diffuser 43 define a pressure-increasing portion. Theoretically, in the ejector 40, refrigerant pressure is increased in the mixing portion 42 so that the total momentum of two-kind refrigerant flows is conserved in the mixing portion 42, and refrigerant pressure is increased in the diffuser 43 so that total energy of refrigerant is conserved in the diffuser 43.

The nozzle 41 is a laburl nozzle (refer to Fluid Engineering published by Tokyo University Publication) having a throat portion 41*a* and an expansion portion 41*b*. Here, a cross-sectional area of the throat portion 41*a* is smallest in a refrigerant passage of the nozzle 41. As shown in FIG. 3A, an inner radial dimension d2 of the expansion portion 41*b* is gradually increased from the throat portion 41*a* toward a downstream end of the nozzle 41. As shown in FIG. 2, a needle valve 44 is displaced by an actuator 45 in an axial direction of the nozzle 41, so that an open degree of the throat portion 41*a* is adjusted. That is, the throttle degree of the refrigerant passage in the nozzle 41 is adjusted by the displacement of the needle valve 44. In the first embodiment, an electric actuator such as a linear solenoid motor and a stepping motor including a screw mechanism is used as the actuator 45, and pressure of high-pressure refrigerant is detected with a pressure sensor (not shown). Then, the open degree of the throat portion 41*a* is adjusted so as to control the detected pressure at a predetermined pressure.

The needle valve 44 is disposed upstream of the throat portion 41*a* in the refrigerant passage of the ejector 40. Further, as shown in FIG. 3A, a taper portion of the needle valve 44 and an inner wall surface of the nozzle 41 are formed so that a throttle portion 41*c* is formed upstream from the throat portion 41*a*, so that refrigerant from the radiator 20 is decompressed into a gas-liquid two-phase state at the upstream of the throat portion 41*a*. Here, a cross-sectional area of the throttle portion 41*c* is determined by the needle valve 44 and the nozzle 41, and is smallest in the refrigerant passage of the nozzle 41. Specifically, as shown FIG. 3B, the inner wall surface of the nozzle 41 has at least two taper angles $\alpha 1$, $\alpha 2$ (refer to Japanese Industrial Standards B 0612), and is formed in a two-step taper shape so that an inner radial dimension dl is reduced toward the throat portion 41*a*. Further, a top end portion of the needle valve 44 is formed in an approximate cone shape so that a cross-sectional area of the needle valve 44 is reduced toward the top end thereof.

Next, operational effects of the ejector 40 according to the first embodiment will be now described. As shown in FIGS. 3A, 3B, the sectional area of the refrigerant passage, defined by the nozzle 41 and the needle valve 44, reduces toward the throttle portion 41*c*. Therefore, a flow speed of refrigerant, flowing from the radiator 20 into the nozzle 41, increases toward the throttle portion 41*c* while a flow amount of the refrigerant becomes a flow amount determined by the open degree of the nozzle 41. On the other hand, the sectional area of the refrigerant passage is slightly increased from the throttle portion 41*c* to the downstream end of the needle valve 44. However, an increase rate of the sectional area is a little in the refrigerant passage from the throttle portion 41*c* to the downstream end of the needle valve 44, as compared with the expansion portion 41*b*. Therefore, in the refrigerant passage between throttle portion 41*c* and the downstream end of the needle valve 44, refrigerant flow acceleration due to expansion and evaporation of refrigerant is not caused, and large turbulence is not generated in speed boundary layers of refrigerant flowing on and around a surface of the needle valve 44.

Further, the sectional area of the refrigerant passage in the nozzle 41 reduces again from the top end of the needle valve 44 to the throat portion 41*a*. Therefore, between the top end of the needle valve 44 and the throat portion 41*a*, refrigerant flow is throttled and accelerated while a little turbulence, generated between throttle portion 41*c* and the top end of the needle valve 44, is rectified. Further, the rectified refrigerant passes through the throat portion 41*a*, and flows into the expansion portion 41*b*. Then, in the expansion portion 41*b*, the refrigerant is expanded, and is accelerated to a speed equal to or higher than the sound speed. At this time, since the refrigerant, passing through the throat portion 41*a*, has a little turbulence, eddy loss generated due to the turbulence can be restricted in the expansion portion 41*b*.

Figure 4:
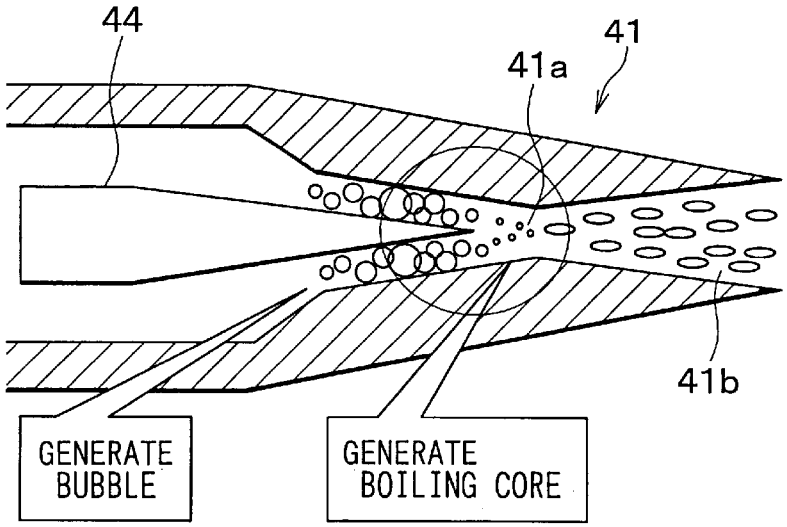
FIG. 4 is an enlarged schematic diagram for explaining an operational effect of the nozzle of the ejector according to the first embodiment.

The refrigerant from the radiator 20 is decompressed in the ejector 41 at an upstream portion from the throat portion 41*a* to be gas-liquid two-phase refrigerant. Therefore, as shown in FIG. 4, refrigerant bubbles, generated upstream of the throat portion 41*a*, are more compressed as toward the throat portion 41*a*. Then, the number of the refrigerant bubbles is reduced, and boiling cores are generated at the throat portion 41*a*. When the refrigerant flows into the expansion portion 41*b* through the throat portion 41*a*, the boiling cores are again boiled, thereby facilitating refrigerant boiling in the expansion portion 41*b*, and accelerating the refrigerant to be equal to or higher than the sound speed. In the first embodiment, a flow amount of refrigerant is not adjusted by directly changing the cross-sectional area of the refrigerant passage in the throat portion 41*a*. Actually, refrigerant is decompressed to the gas-liquid two-phase refrigerant in the refrigerant passage upstream from the throat portion 41*a*, and refrigerant bubbles are generated in the gas-liquid refrigerant, so that a mass density of refrigerant is reduced. Accordingly, the cross-sectional area of the refrigerant passage in the nozzle 41 is relatively reduced. Thus, the flow amount of refrigerant can be adjusted, and the refrigerant passage can be prevented from being throttled more than a necessary degree. Accordingly, as shown at the right side (present-invention test result) in FIG. 5, ejector efficiency $\eta e$ can be prevented from being largely reduced.

Figure 5:
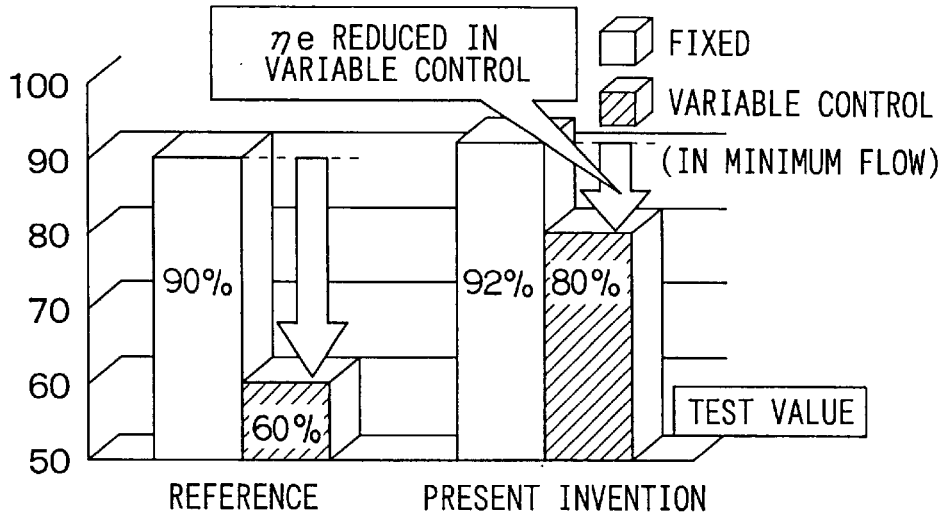
FIG. 5 is a bar graph showing a comparison between efficiency of the ejector according to the first embodiment and efficiency of a reference ejector.

In FIG. 5, "FIXED" represents a nozzle having a fixed shape most suitable for a flow amount of refrigerant, and "CONTROL" represents a nozzle having a refrigerant passage throttled by the needle valve 44. In the present invention, since refrigerant can be accurately and sufficiently accelerated by the nozzle 41, the ejector efficiency $\eta e$ can be improved. As a result, the throttle degree of the nozzle 41 can be controlled in accordance with a refrigerant flow amount while the ejector efficiency $\eta e$ can be maintained at a high level.

Figure 6:
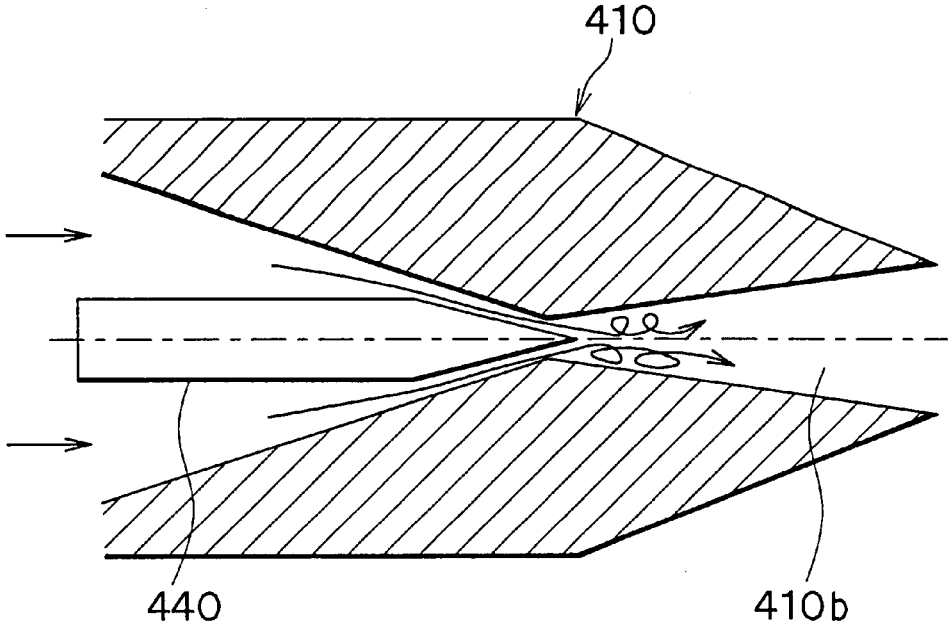
FIG. 6 is an enlarged schematic diagram for explaining a trouble in a nozzle of a reference ejector.

Further, a reference test result is shown at the left side in FIG. 5, and the ejector efficiency $\eta e$ of a refrigerant ejector is largely reduced as compared with the present embodiment. The reference test was performed by using a nozzle 410 shown FIGS. 6, 7. As shown FIG. 6, the inventors of the present invention studied a reference ejector 410 including a needle valve 440 for adjusting a throttle degree of the nozzle 410. The needle valve 440 has a cone-shaped top end, and is displaced in the nozzle 410 to adjust the throttle degree. In this case, refrigerant, flowing on and around the surface of the needle valve 440, flows along the surface of the cone-shaped top end of the needle valve 440. Therefore, the refrigerant streams along the surface of the cone-shaped top end collide with each other on a downstream side of the top end of the needle valve 440. Thus, an eddy loss due to refrigerant turbulence is generated in refrigerant streams and speed boundary layers of the refrigerant passage at a downstream side from the needle valve 440. Accordingly, a refrigerant flow speed is reduced even on a center axial line of the nozzle 410 in an expansion portion 410*b* of the nozzle 410. Originally, the refrigerant flow speed on the center axial line becomes highest. Therefore, refrigerant cannot be sufficiently accelerated by the nozzle 410, and the ejector efficiency $\eta e$ is reduced.

Figure 7:
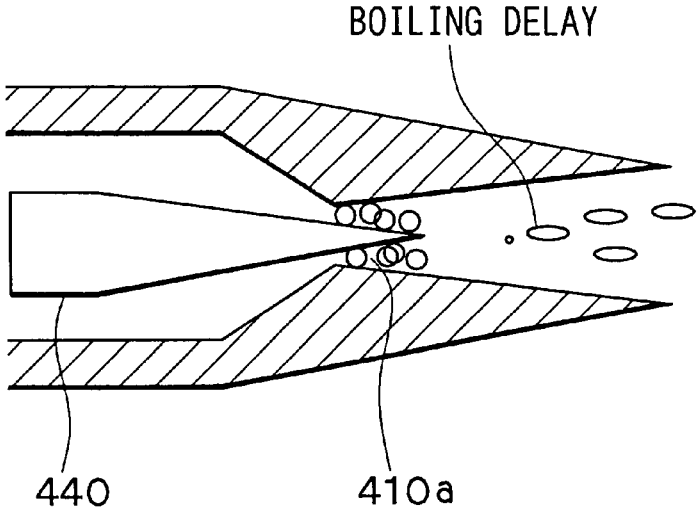
FIG. 7 is an enlarged schematic diagram for explaining a trouble in a nozzle of another reference ejector.

On the other hand, as shown in FIG. 7, if the cross-sectional area of the refrigerant passage is simply controlled at the throat portion 410*a* so that the cross-sectional area of a space around the nozzle 410 is smallest at the throat portion 410*a*, refrigerant bubbles due to refrigerant boiling are readily generated downstream from the throat portion 410*a*. When refrigerant bubbles are generated in the refrigerant passage downstream from the throat portion 410*a*, the cross-sectional area of the refrigerant passage on the downstream side of the throat portion 410*a* is substantially reduced due to the refrigerant bubbles. Thus, the refrigerant passage is throttled more than a necessary level, and the ejector efficiency $\eta e$ is largely reduced as compared with the ejector having a fixed nozzle. Here, refrigerant can be decompressed to a pressure higher than saturation vapor pressure of refrigerant in the nozzle 410, in order to prevent the bubbles from being generated. However, an adiabatic heat fall (enthalpy change amount) due to the decompression around the saturation vapor pressure, is small. Therefore, it is difficult for the ejector 400 to recover a sufficient amount of energy. Furthermore, since the pumping function of the ejector 400 is small, a sufficient amount of refrigerant cannot be circulated to the evaporator 30.

According to the first embodiment of the present invention, the refrigerant is decompressed to the gas-liquid two-phase refrigerant at an upstream side of the throat portion 41*a*. Therefore, it can prevent the refrigerant from being throttled more than a necessary degree while the ejector efficiency can be effectively improved.

(Second Embodiment)

Figure 3B:
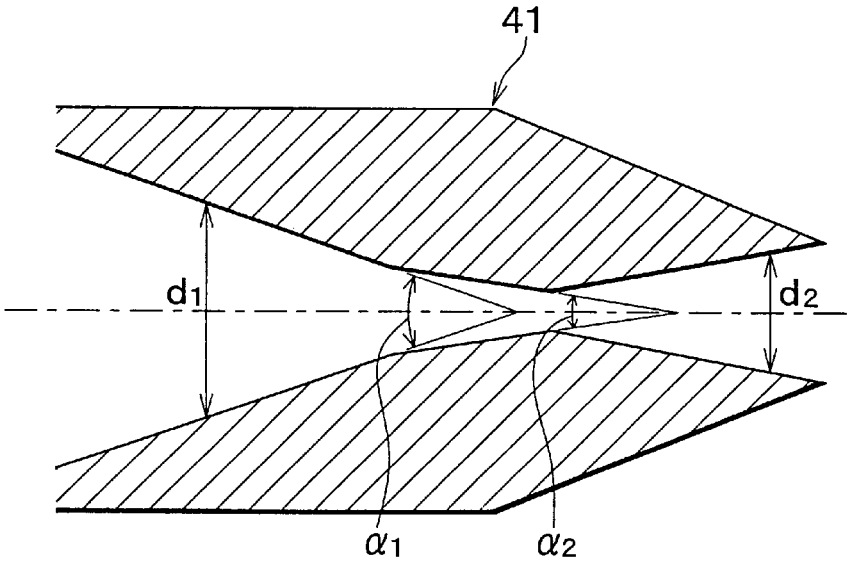
FIG. 3B is an enlarged schematic diagram showing an inner wall shape of the nozzle shown in FIG. 3A.
Figure 8:
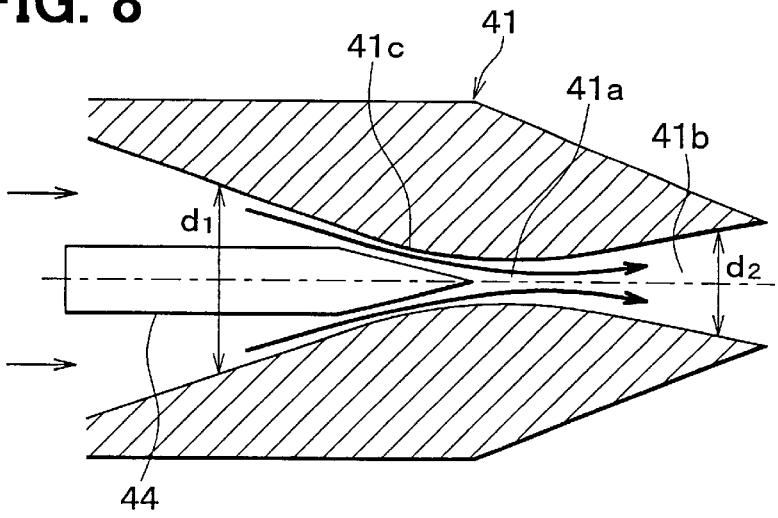
FIG. 8 is an enlarged schematic diagram showing a nozzle according to a second embodiment of the present invention.

In the above-described first embodiment, as shown FIG. 3B, the inner wall surface of the nozzle 41 are formed into the two-step taper shape to have two taper angles $\alpha 1$, $\alpha 2$, so that the inner radial dimension d1 is reduced toward the throat portion 41*a*. However, in the second embodiment, as shown in FIG. 8, the inner wall surface has a taper angle gradually reduced toward the throat portion 41*a*, and is formed in a non-step taper shape so that the inner radial dimension d1 is reduced toward the throat portion 41*a*. Accordingly, the cross-sectional area of the refrigerant passage is smoothly and continuously changed in the nozzle 41, and turbulence can be further restricted from being generated in the refrigerant stream.

In the second embodiment, the other parts are similar to those of the above-described first embodiment. Accordingly, similarly to the first embodiment, the refrigerant is decompressed to the gas-liquid two-phase state at an upstream side of the throat portion 41*a*.

(Third Embodiment)

Figure 9A:
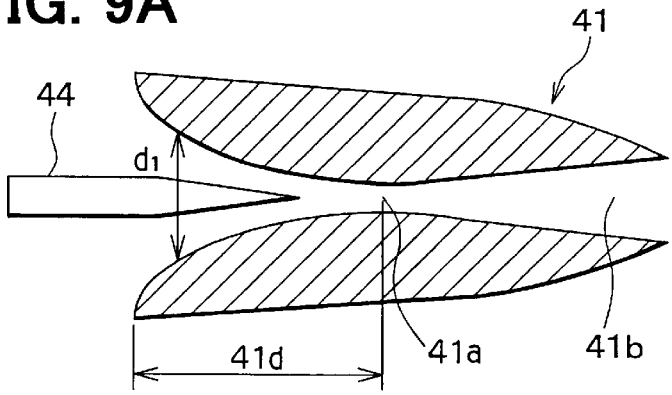
FIG. 9A is an enlarged schematic diagram showing a nozzle according to a third embodiment of the present invention.
Figure 9B:
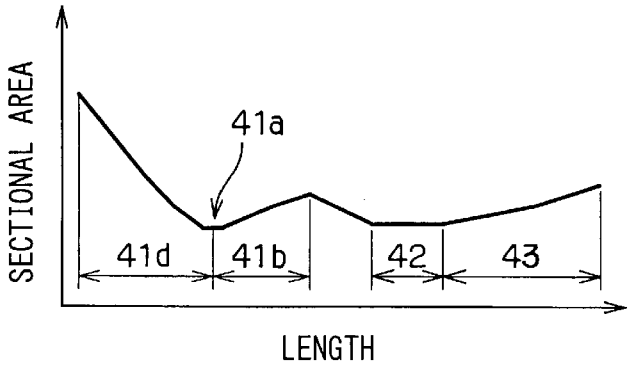
FIG. 9B is a graph showing a sectional area change in a refrigerant passage of the nozzle shown in FIG. 9A and in a mixing portion and a diffuser shown in FIG. 2 in an axial direction of the nozzle.

In the third embodiment, as shown in FIGS. 9A, 9B, the inner wall surface of the nozzle 41 is formed as a smoothly curved surface so that refrigerant is decompressed to the gas-liquid phase state at upstream from the throat portion 41*a*. In FIGS. 9A, 9B, 41*d* indicates an upstream area portion of the throat portion 41*a*, where the inner radial dimension d1 is reduced toward the throat portion 41*a*. Further, the nozzle 41, the mixing portion 42 and the diffuser 43 are set in the ejector 40 to have the sectional areas shown in FIG. 9B.

In the third embodiment, the other parts are similar to those of the above-described first embodiment. Accordingly, similarly to the first embodiment, the refrigerant is decompressed to the gas-liquid two-phase state at an upstream side of the throat portion 41*a*.

Although the present invention has been fully described in connection with the preferred embodiments thereof with reference to the accompanying drawings, it is to be noted that various changes and modifications will become apparent to those skilled in the art.

For example, in the above-described embodiments of the present invention, the top end shape of the needle valve 44 and the inner wall shape of the nozzle 41 are set so that the throttle portion 41*c* is formed upstream from the throat portion 41*a*, and refrigerant is decompressed to the gas-liquid refrigerant at the upstream of the throat portion 41*a*. However, without being limited to this manner, the top end shape of the needle valve 44 and the inner wall shape of the nozzle 41 may be determined only so that refrigerant is decompressed to the gas-liquid two-phase refrigerant at upstream from the throat portion 41*a*. In the above embodiments, the pressure of high-pressure refrigerant is detected as a physical value corresponding to refrigerant pressure in the refrigerant cycle, and the actuator 45 is controlled based on the detected refrigerant pressure. However, in the present invention, the actuator 45 may be controlled based on a physical value relative to the refrigerant pressure, such as a temperature of high-pressure refrigerant, a temperature of water for the water heater and an amount of refrigerant flowing into the nozzle 41.

In the above embodiments, the throttle degree of the nozzle 41 is controlled so that the high-pressure refrigerant is set at the predetermined pressure. However, for example, the throttle degree may be controlled so that a ratio of heating performance of the radiator 20 to motive power consumed by the compressor 10, that is, a performance coefficient of the ejector cycle, is set higher than a predetermined value. In the above-described embodiments, the present invention is typically applied to the water heater. However, without being limited to the water heater, the present invention can be applied to another ejector cycle such as a refrigerator, a freezer and an air conditioner. The actuator 45 may be a mechanical actuator using the pressure of inert gas or may be a non-electromagnetic electric actuator using piezoelectric elements. For example, the electric actuator is a stepping motor or a linear solenoid motor.

Such changes and modifications are to be understood as being within the scope of the present invention as defined by the appended claims.

What is claimed is:

1. An ejector decompression device for a refrigerant cycle that includes a radiator for radiating heat of refrigerant compressed by a compressor, and an evaporator for evaporating refrigerant after being decompressed, the ejector decompression device comprising:

a nozzle having an inner wall defining a refrigerant passage, for decompressing and expanding refrigerant flowing from the radiator by converting pressure energy of refrigerant to speed energy of the refrigerant, the nozzle including a throat portion having a cross-sectional area that is smallest in the refrigerant passage of the nozzle, and an expansion portion in which the cross-sectional area is increased toward downstream in a refrigerant flow;

a pressure-increasing portion that is disposed to increase a pressure of refrigerant by converting the speed energy of refrigerant to the pressure energy of refrigerant while mixing refrigerant injected from the nozzle and refrigerant sucked from the evaporator; and a needle valve disposed to be displaced in the refrigerant passage of the nozzle in an axial direction of the nozzle, for adjusting an opening degree of the refrigerant passage of the nozzle, wherein the needle valve and the inner wall of the nozzle are provided to have predetermined shapes so that refrigerant flowing into the nozzle is decompressed to a gas-liquid two-phase state at upstream from the throat portion in the refrigerant flow.

2. The ejector decompression device according to claim 1, wherein the needle valve has a downstream end that is disposed to be displaced in the refrigerant passage of the nozzle, in an area upstream from the throat portion.

3. The ejector decompression device according to claim 1, wherein:

the needle valve is disposed in the refrigerant passage of the nozzle to define a throttle portion having a cross-sectional area that is smallest in a space between the needle valve and the inner wall of the nozzle; and the needle valve and the inner wall of the nozzle are provided such that the throttle portion is positioned upstream from the throat portion in the refrigerant flow.

4. The ejector decompression device according to claim 1, wherein:

the needle valve has a downstream portion that is tapered toward a downstream end of the needle valve so that a cross-sectional area of the downstream portion of the needle valve is reduced toward the downstream end;

the inner wall of the nozzle is formed into an approximate cone shape having at least two different taper angles, upstream from the throat portion; and the inner wall has a radial dimension that is reduced toward the throat portion.

5. The ejector decompression device according to claim 1, wherein:

the needle valve has a downstream portion that is tapered toward a downstream end of the needle valve so that a cross-sectional area of the downstream portion of the needle valve is reduced toward the downstream end; and the inner wall of the nozzle has a radial dimension that is reduced from an upstream end of the nozzle toward the throat portion and is increased from the throat portion toward a downstream end of the nozzle.

6. The ejector decompression device according to claim 1, further comprising:

an electric actuator for displacing the needle valve in the refrigerant passage of the nozzle.

7. The ejector decompression device according to claim 6, further comprising:

a detecting unit for detecting a physical value relative to a refrigerant pressure in the refrigerant cycle; and a controller for controlling operation of the electric actuator based on the physical value detected by the detecting unit.

8. The ejector decompression device according to claim 6, wherein the electric actuator is a stepping motor.

9. The ejector decompression device according to claim 6, wherein the electric actuator is a linear solenoid motor.

10. The ejector decompression device according to claim 1, wherein a pressure of refrigerant in the radiator becomes equal to or higher than the critical pressure of the refrigerant.

11. The ejector decompression device according to claim 1, wherein the refrigerant is carbon dioxide.

12. The ejector decompression device according to claim 1, wherein the needle valve and the inner wall of the nozzle have a means for decompressing refrigerant flowing into the nozzle to a gas-liquid two-phase state at upstream from the throat portion in the refrigerant flow.

13. An ejector decompression device for a refrigerant cycle that includes a radiator for radiating heat of refrigerant compressed by a compressor, and an evaporator for evaporating refrigerant after being decompressed, the ejector decompression device comprising:

a nozzle having an inner wall defining a refrigerant passage, for decompressing and expanding refrigerant flowing from the radiator by converting pressure energy of refrigerant to speed energy of the refrigerant, the nozzle including a throat portion having a cross-sectional area that is smallest in the refrigerant passage of the nozzle, and an expansion portion in which the cross-sectional area is increased from the throat portion toward downstream in a refrigerant flow;

a pressure-increasing portion that is disposed to increase a pressure of refrigerant by converting the speed energy of refrigerant to the pressure energy of refrigerant while mixing refrigerant injected from the nozzle and refrigerant sucked from the evaporator; and a needle valve disposed to be displaced in the refrigerant passage of the nozzle in an axial direction of the nozzle, for adjusting an opening degree of the refrigerant passage of the nozzle and an electric actuator for displacing the needle valve in the refrigerant passage of the nozzle; wherein:

the needle valve and the inner wall of the nozzle are provided to define therebetween a throttle portion at which a passage sectional area becomes smallest; and the throttle portion is provided upstream from the throat portion in the refrigerant flow.

14. The ejector decompression device according to claim 13, further comprising;

a detecting unit for detecting a physical value relative to a refrigerant pressure in the refrigerant cycle; and a controller for controlling operation of the electric actuator based on the physical value detected by the detecting unit.

15. The ejector decompression device according to claim 13, wherein the electric actuator is a stepping motor.

16. The ejector decompression device according to claim 13, wherein the electric actuator is a linear solenoid motor.

17. The ejector decompression device according to claim 13, wherein the throttle portion is controlled to decompress refrigerant to a gas-liquid two-phase state at upstream from the throat portion in the refrigerant flow.

* * * * *